United States Patent [19]

Heinonen

[11] Patent Number: 4,479,278

[45] Date of Patent: Oct. 30, 1984

[54] SCRUBBING MEANS

[76] Inventor: Ahti Heinonen, SF-25760 Toija, Finland

[21] Appl. No.: 351,857

[22] Filed: Feb. 24, 1982

[51] Int. Cl.[3] ..... A47L 13/142; A47L 13/20

[52] U.S. Cl. ..... 15/120 A; 15/229 B

[58] Field of Search ..... 15/120 A, 120 R, 228, 15/229 R, 229 B

[56] References Cited

U.S. PATENT DOCUMENTS

| | | | |
|---|---|---|---|
| 1,520,500 | 12/1924 | Jumonville | 15/120 A |
| 1,760,695 | 5/1930 | Hertzberg | 15/120 A |
| 2,677,838 | 5/1954 | Jouban | 15/120 A |

FOREIGN PATENT DOCUMENTS

| | | | |
|---|---|---|---|
| 446142 | 3/1949 | Italy | 15/120 A |
| 450609 | 7/1936 | United Kingdom | 15/120 A |

*Primary Examiner*—Chris K. Moore

*Attorney, Agent, or Firm*—Andrus, Sceales, Starke & Sawall

[57] ABSTRACT

A scrubbing means, comprising a shaft (1) consisting of an outer tube (2) and within this a movable inner shaft (3), the outer tube and inner shaft being provided with fixing heads (4,5); and a mop (6) composed of mop threads (7); the mop being attached on one hand to the outer tube and on the other hand to the inner shaft to be wrung dry with the aid of the fixing heads by rotating the outer tube and inner shaft with reference to each other.

The fixing head (4) of the outer tube (1) comprises a tapered fixing member (8) expanding in the direction of the fixing head and provided with external radial shoulders (9), and the mop (3) is attached to the fixing member by means of an annular tie member (10), the circumferential dimension of which is less than the largest circumferential dimension of the fixing member.

4 Claims, 5 Drawing Figures

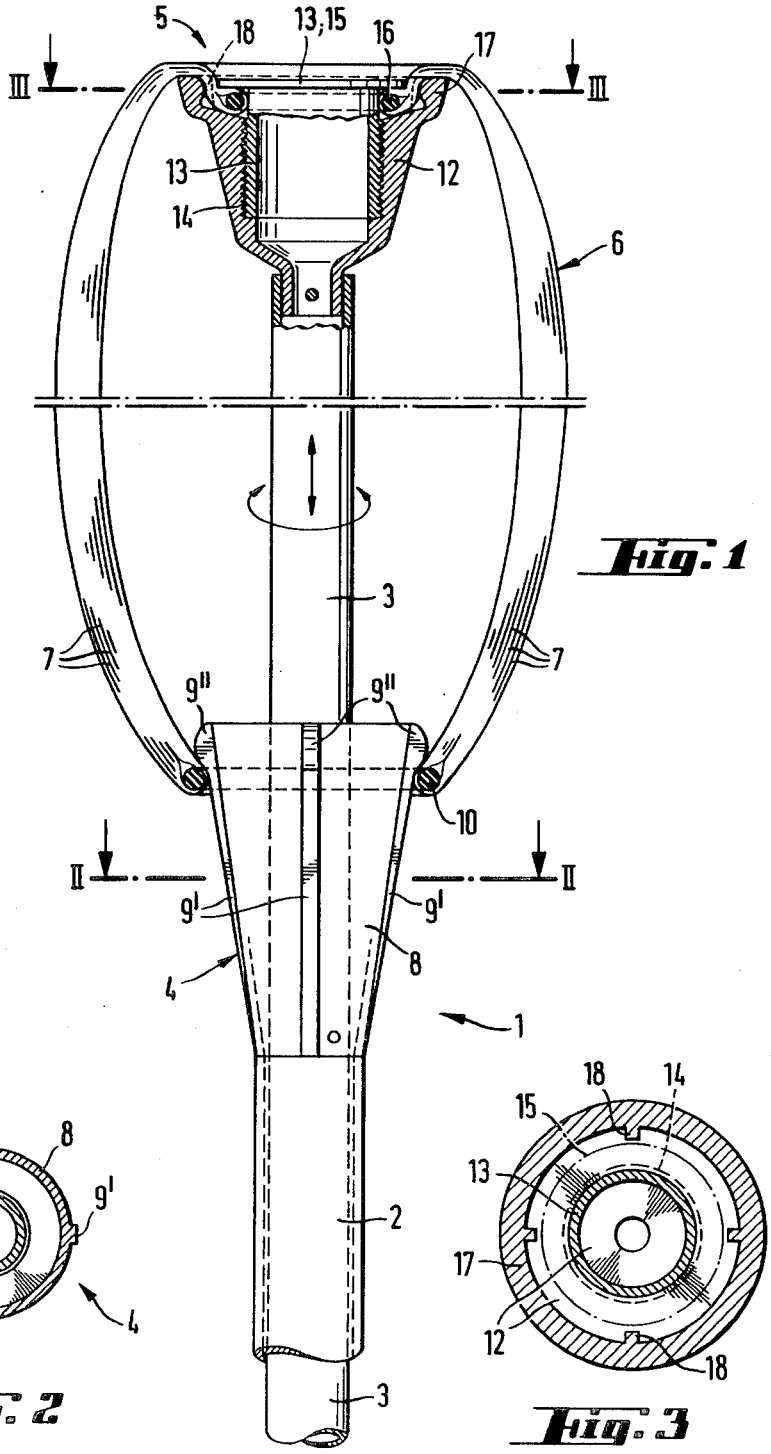
Fig. 1
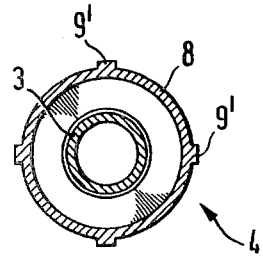
Fig. 2
Fig. 3

SCRUBBING MEANS

BACKGROUND OF THE INVENTION

The present invention concerns a scrubbing means.

It is known in the art to attach a mop to a scrubbing means e.g. by press buttons, by a cotter pin and other commonly known fixing means. These fixing means of prior art are not satisfactory in mops of the type mentioned above owing to their inconvenient and cumbersome use, their tendency to be easily undone, the special requirements they impose on the mop (e.g. fixing elements for affixing an attachment means to the mop) and owing to the fact that in instances they permit free rotation of the mop at least with reference to one fixing head of the shaft.

On the fixing heads of the scrubbing means alluded to in the introduction certain requirements are imposed which a usable and competitive mop should meet. In order to enable the mop to be wrung dry, the fixing heads should attach the mop subtstantially unrotatably to both fixing heads. Furthermore, with a view to enabling replacement of the mop, it must be possible to detach and reattach the mop easily and rapidly from/to both fixing heads. Furthermore, the structural designs of the fixing heads should be such that the fixing heads can be manufactured rapidly, by simple procedures and at low cost. Moreover, the fixing heads, and in particular the fixing arrangement, must not impose on the mop such structural requirements which would hamper the industrial large scale production of the mop, in other words, it should be possible to attach the mop to the fixing heads without any fixing elements which have to be affixed in separate work steps.

Scrubbing means and mop attaching means known at present fail to meet the above requirements.

SUMMARY OF THE INVENTION

The object of the present invention is to provide a new type of scrubbing means of which the fixing heads and in particular the fixing head of the outer shaft, of the so-called outer tube, meet the requirements mentioned in the foregoing.

DESCRIPTION OF THE DRAWINGS

The invention is described in the following in detail with the aid of embodiment examples, with reference to the attached drawing, wherein:

FIG. 1 presents in elevational view, and partly sectioned, a scrubbing means according to the invention, FIG. 2 shows the section along line II—II in FIG. 1, FIG. 3 shows the section along line III—III in FIG. 1.

DESCRIPTION OF THE ILLUSTRATED EMBODIMENT

Figure 4:
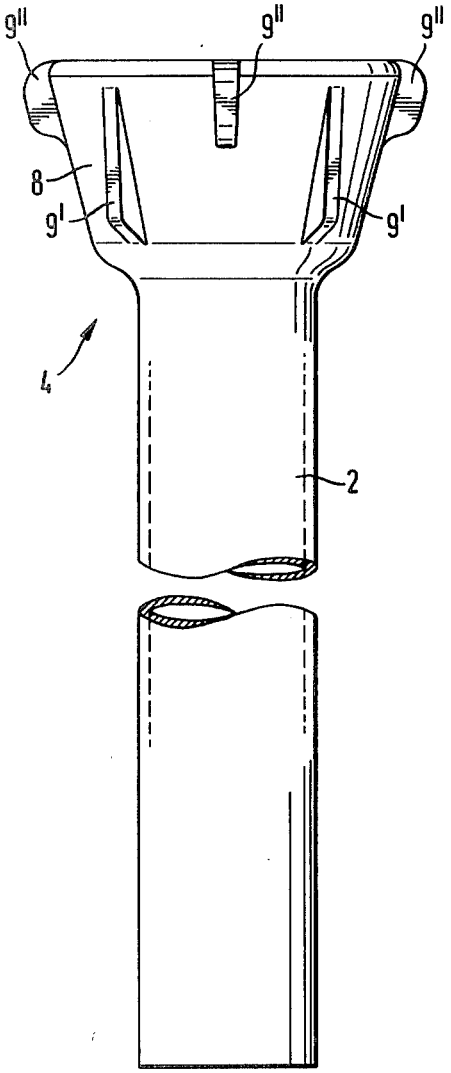
FIG. 4 presents in elevational view the outer tube fixing head of a scrubbing means according to another embodiment of the invention.

The scrubbing means depicted in FIGS. 1 and 2 comprises a shaft 1, consisting of the outer tube 2 and of the inner shaft 3 located therewithin and which is movable longitudinally to the shaft 1 and rotatable. The scrubbing means further comprises a mop 6 composed of threads 7 or the like attached by one end to the fixing head 4 of the outer tube 2 and by the other ends to the fixing head 5 of the inner shaft 3. When then the outer tube 2 and the inner shaft 3 are rotated with reference to each other, the mop 6 will be wound tightly upon the inner shaft, the water being expressed from the mop.

As taught by the invention, the fixing head 4 of the outer tube 2 comprises a fixing member 8 widening in the direction of the fixing head and substantially unrotatable with reference to the outer tube, and on which external radial shoulders 9', 9'' have been provided. The mop 6 has been affixed to the fixing member 8 with the aid of an annular tie member 10, which has a circumferential dimension smaller than the largest circumferential dimension of the fixing member. The threads 7 forming the mop 6 pass under the tie member 10, and over it, being held on one hand by the tie member and on the other hand lying against the outer surface of the fixing member 8 and its shoulders 9', 9'', these latter preventing rotation of the mop with reference to the fixing member 8.

In the embodiment depicted, the fixing member 8 is shaped like a circular cone, longitudinal ridges 9' provided on the surface of the fixing member constituting the said shoulders. The outer ends of the shoulders 9' in the direction of the fixing head 4 of the outer tube 2 protrude outward and thereby form eminences 9'', at which the circumferential dimension of the fixing member is at its maximum.

In the embodiment depicted in FIGS. 1 and 3, the fixing head 5 of the inner shaft 3 comprises a seat 12 substantially unrotatable with reference to the shaft and opening in cup fashion in the direction of the fixing head, further a locking body 13, this latter being locked within the seat by means of threads 14 on the outside of the locking body and threads 14 in the inner surface of the seat. The part of the locking body 13 projecting from the seat 12 constitutes a shoulder border 15 spreading out to the sides and behind which the mop has been affixed with the aid of an annular tie member 16 so that the mop threads 7 run between the border 15 and the seat 12 when the tie has been wound round the locking body between the shoulder border and the seat. The circumferential dimension of the tie 16 is shorter than the circumferential dimension of the shoulder border 15.

In the embodiment of FIGS. 1 and 3, the seat 12 forms a covering border 17 projecting in the direction of the fixing head and which covers the tie 16 and, in part at least, the shoulder border 15 of the locking body 13, the shoulders 18 projecting towards the axis of the shaft 1 that have been provided on the inner surface of the covering border preventing any rotation of the mop with reference to the shoulder border and thus to the seat.

For detaching the mop of FIG. 1, the locking body 13 is unscrewed from the seat 12, whereby one end of the mop 6 comes off the fixing head 5 of the inner shaft. Thereafter the outer tube 2 is pushed through the mop so that the outer tube passes through the annular tie member 10 in the direction of the fixing head.

For fixing the mop 6 of FIG. 1 to the scrubbing means, the shaft 1 is pushed through the mop so that the annular tie member 10 settles on the surface of the conical fixing member 8 of the outer tube, carried by the shoulders 9',9'', whereafter one end of the mop is affixed to the seat 12 of the inner shaft 3 with the aid of the locking body 13 so that the locking body passes partly through the tie 16, while this latter is supported between the shoulder border 15 and the seat. The locking body 13, the seat 12 and the covering border 17 have been appropriately dimensioned so that the locking body lies in its entirety including its shoulder border 15 within the seat and the covering border, with the locking body e.g. 5-10-20 mm deeper than the covering border, as viewed from the direction of the locking head.

In FIG. 4 is seen the fixing member 8, unrotatably affixed to the lower end of the outer tube 2 of the shaft 1 and conically widening in the direction of the lower end, and which has been provided with external, radial ridge-like shoulders 9'. The shoulders 9' rise out of the conical surface of the fixing member 8 in the direction farther away from the fixing head 4. The fixing head 4 further comprises shoulders 9'' projecting radially out of the surface of the fixing head and which are located on the outer surface of the fixing member in its very part farthest away from the shaft 1. The mop may then be attached to the fixing member with the aid of an annular tie member, which is fitted upon the ridge-like shoulders 9' behind the eminences 9'', as viewed from the direction of the fixing head.

Figure 5:
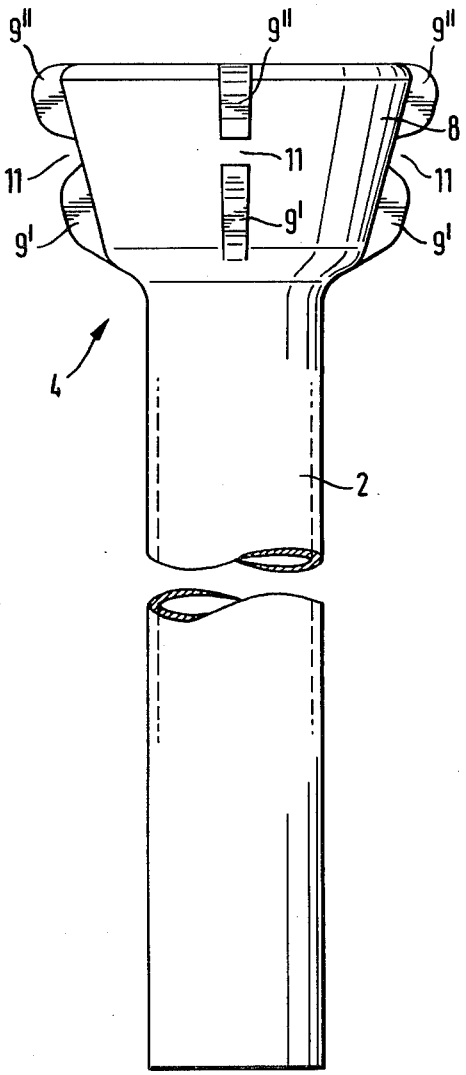
FIG. 5 presents likewise in elevational view the outer tube fixing head according to a third embodiment of the invention.

The fixing head 4 of the outer tube 2 of the shaft 1 depicted in FIG. 5 likewise comprises a fixing member 8 conically widening in the direction of the fixing head and on the surface of which have been provided ridge-like shoulders 9 parallelling the shaft 1. In the shoulders 9 grooves 11 have been formed substantially in the same location as seen in the longitudinal direction of the shaft 1, so that the mop is attachable with the aid of a tie member at said grooves so that the mop is held on one hand against the eminences 9'' formed by the parts of the shoulders adjacent to the fixing head and on the other hand by the parts 9' of the shoulders adjacent to the shaft 1.

The mop 6 of the scrubbing means of the invention is attachable to the shaft 1 whichever way around, in other words, the circumferential dimensions of the tie members 10 and 16 are preferably equal and the mop is preferably symmetrical. The tie elements 10 and 16 may also be somewhat resilient or tightenable.

In the scrubbing means of the invention the mop is easy to replace when damaged or worn out. The scrubbing means is easy in maintenance and use and its structural design is simple and clear-cut. Thanks to the fixing means no special fixing elements required e.g. for press-button attachment, cotter pin attachment or other modes of attachment need be provided on the mop, and the mop is eminently suitable to be manufactured in large scale production at low cost.

The embodiment examples are meant to illustrate the invention, without confining it in any way.

I claim:

1. A scrubbing apparatus comprising an inner shaft, a tubular member disposed around the shaft and movable longitudinally and rotatable with respect to the shaft, a mop composed of a plurality of strands, a first head connecting one end of the mop to the inner shaft, a second head non-rotatably secured to the outer tubular member, said second head having a tapered outer surface that increases in diameter in a direction toward said first head, said second head having a large diameter end and a small diameter end, at least one longitudinally extending rib on the outer surface of said second head, an annular tie member connected to the opposite end of the mop and disposed around said second head, said strands extending between said tie member and said second head, the large diameter end of said second head having a greater diameter than the inner diameter of said annular tie member to prevent displacement of said tie member from the large diameter end of said second head in the direction of said first head, said opposite end of said mop being held between said tie member and the outer surface of said second head and said rib preventing rotation of the mop with respect to said second head said first head including a seat and a locking body having an annular shoulder, a second annular tie member connecting the first end of the mop to said shoulder, said second annular tie member being retained between said seat and said shoulder to thereby prevent rotation of the mop with reference to said seat.

2. The apparatus of claim 1, and including a projection disposed adjacent the large diameter of said second head to be engaged by said annular tie member.

3. The apparatus of claim 2, wherein said second head has a plurality of longitudinally extending ribs and a plurality of projections, and the ends of said ribs form said projections.

4. The apparatus of claim 1, and including a plurality of circumferentially spaced longitudinally extending ribs, said ribs having grooves at substantially equivalent locations in the longitudinal direction for receiving said annular tie member.

* * * * *